US005681206A

United States Patent [19]

Mesher

[11] Patent Number: 5,681,206

[45] Date of Patent: Oct. 28, 1997

[54] METHOD OF ACCELERATING FLUIDIZED PARTICULATE MATTER

[76] Inventor: Terry Mesher, 176 Little Eldon Place, Victoria, British Columbia, Canada, V8Z 1E3

[21] Appl. No.: 773,228

[22] Filed: Dec. 23, 1996

Related U.S. Application Data

[60] Division of Ser. No. 421,778, Apr. 14, 1995, Pat. No. 5,601,478, which is a continuation-in-part of Ser. No. 203, 584, Mar. 1, 1994, abandoned.

[51] Int. Cl.[6] ..... B24C 3/12; B24C 1/00

[52] U.S. Cl. ..... 451/39; 451/38

[58] Field of Search ..... 239/591, 691; 361/213, 227, 228, 229; 451/38, 39, 40, 75, 90, 91, 102

[56] References Cited

U.S. PATENT DOCUMENTS

| | | | |
|---|---|---|---|
| 998,762 | 7/1911 | Faller . | |
| 2,699,403 | 1/1955 | Courts | 117/47 |
| 4,389,820 | 6/1983 | Fong et al. . | |
| 4,555,872 | 12/1985 | Yie | 451/102 |
| 4,806,171 | 2/1989 | Whitlock et al. | 451/75 |
| 4,819,837 | 4/1989 | Goforth | 222/402.1 |
| 4,843,770 | 7/1989 | Crane et al. | 451/102 |
| 4,872,615 | 10/1989 | Myers | 451/102 X |
| 5,054,249 | 10/1991 | Rankin | 451/102 X |
| 5,421,766 | 6/1995 | Shank, Jr. | 451/102 X |

FOREIGN PATENT DOCUMENTS

| | | |
|---|---|---|
| 0182342 | 5/1986 | European Pat. Off. . |
| 2706525 | 8/1978 | Germany . |

*Primary Examiner*—Timothy V. Eley
*Attorney, Agent, or Firm*—Brian M. Long

[57] ABSTRACT

In a method of accelerating and pressurizing a fluidized stream of particulate material, e.g. for blast cleaning by ice particles, the stream flows through a constriction in a flow passage. A flow of blast medium is discharged from a blast nozzle at supersonic speed into the fluidized stream so as to form within the fluidized stream a flow front which is impenetrable by the fluidized stream and which co-operates with the constriction to form an effective nozzle for accelerating the fluidized stream. Grounding is provided controlling electrostatic charges for either better work effect or neutralization in unwanted or hazardous conditions, and safety pressure relief, blast intensity control, articulation and changement of final nozzles for effective operation are also provided.

8 Claims, 4 Drawing Sheets

METHOD OF ACCELERATING FLUIDIZED PARTICULATE MATTER

CROSS-REFERENCE TO RELATED APPLICATION

This is a division of Ser. No. 08/421,778, filed Apr. 14, 1995, now U.S. Pat. No. 5,601,478 which is a continuation-in-part of Ser. No. 08/203,584, filed Mar. 1, 1994, now abandoned.

BACKGROUND OF THE INVENTION

1. Field of the Invention

This invention relates to a method of accelerating and pressurizing a fluidized stream of particulate matter for the purposes, for example, of duct transport over long distances and for the discharge of the fluidized streams at high velocities.

2. Description of the Related Art

In abrasive blast cleaning, such as with sand, grit or shot particles, velocity is imparted to particles which are directed against a surface to be cleaned, depainted, radioactively decontaminated or otherwise modified. The dynamic particle energy is converted into destructive forces which mechanically abrade or deform surface coatings. This methodology results in residual particulate matter of the blast stream, blast medium and the material removed as the blasting strips off the coating of the target surface, creating a high dust environment that may be hazardous to health, equipment and surrounding property. The cost of removing such matter may be excessive as well.

In addition, these blast particles are destructive when used for the treatment of fragile surfaces such as thin sheets, carbon and plastic.

Recently, less aggressive particulate matter such as dry ice and water ice has been utilized as blast particulate matter to avoid these problems, but not without limitations relating to transport and discharge. First, ice is not free flowing and must be "fluidized" with a gas, liquified gas or liquid in order to be transported to the target surface. Second, ice is not effective if discharged at low velocities. Third, ice is friable and heat sensitive and high velocity transport will generate considerable friction and heat and cause melting and breakdown of the ice particles. That said, the aim has been to achieve low transport and high discharge velocities within an apparatus that can handle all practical and useful types and sizes of particulate matter, including ice particles, and to control the sizing of particulate matter.

Previous practice of transporting or discharging fluidized particulate matter at high pressures, high velocities or both has involved the use of costly mechanical positive displacement pumps, which are volume dependent, complicated and do not mix or disperse or accelerate a fluidized stream well. Blowers, fans, and air jet and liquid jet pumps have also been used, but are only capable of generating small pressure increases and low velocities.

The use of single venturi nozzles as described in U.S. Pat. Nos. 4,038,786 and 4,707,951, in "Foundations of Aerodynamics" (A. M. Kuethe and J. D. Schetzer) and the "Mechanical Engineers' Handbook" (T. Baumeister and L. S. Marks) is ineffective for increasing pressure as can be achieved by induced flow created by injectors using either gas or liquid. Single venturi nozzles create increased velocity by gas expansion through falling pressures.

Amplifiers, such as taught by U.S. Pat. No. 4,389,820, have been used with limited success to induce flow in significant volumes, but unfortunately are able to generate only minimal pressure differentials and small increases in velocity. This is due to several inherent problems. First, the induction effect is dependent upon the boundary layer formation of a very thin high speed air film which is destroyed by the bombardment of particulate matter. Second, since the induction is via boundary layer shear viscous forces, there is minimal mixing and therefore little energy transfer to the bulk of the induced stream. Third, acceleration by usage of conduit restrictions will greatly affect or destroy the inductive effect, thereby placing a limitation on the effective increase in velocity that may be achieved. Fourth, air amplifiers, as the name implies, use a small amount of high velocity air to form a boundary layer to induce flow of a much larger amount of air and therefore there is little energy available to be transferred either for pressure or velocity increase. Finally, the foregoing limitations in mixing, velocity, available energy and pressure all preclude the possibility for effective high velocity discharge.

Oblique injectors of the form utilized in U.S. Pat. Nos. 4,555,872 and 5,203,794, where air or liquid is introduced via an opening in a main conduit after or before the entry of a particulate stream into the main conduit, have the chief advantage of providing for maximal turbulence and good mixing. However, these effects disturb the natural flow pattern of any incoming particulate stream, thereby preventing the possibility of forming an efficient nozzle. Because of this loss of efficiency, more energy and significant expense are required to achieve optimal pressures and velocities. The disturbance of the natural flow also results in regions of different velocities, thereby causing particulate deposition and plugging, erosion in the apparatus, and unwanted damage to friable, delicate particles including excessive size reduction.

As a variation of these injectors, gas or liquid injectors embodied within nozzles that extend into the main conduit thereby creating a multi-nozzle system have been practised in the art (U.S. Pat. Nos. 998,762, 4,806,171, and 4,817,342). In terms of discharge effectiveness, these systems use inefficient non-venturi converging nozzles, which release an uncontrolled expanded blast pattern. This pattern tends to concentrate the bulk of the particulate matter in a central region and consequently are not suitable for targeting large blast areas. The same may be said of component attachments such as are described in U.S. Pat. No. 4,843,770, which attempt to create a wider blast area using an uncontrolled expanded blast pattern. In addition, these systems tend to plug easily due to the use of non-fluid path defining nozzle body profiles, which create regions of different velocities and depositions.

In the U.S. Pat. No. 998,762, there is disclosed an apparatus for combining comminuted solids and liquids in which an internally rifled air nozzle discharges an air jet into a stream of solid particles, which then passes through a further nozzle. Both of the nozzles comprise a passage converging to an outlet mouth, so that the flow beyond the outlet mouths of the nozzles is uncontrolled. Consequently, the flow beyond the nozzle mouths is allowed to expand freely, to undergo turbulence and to produce excessive mixing, all of which will consume energy that could otherwise be directed for other purposes, and in particular for the acceleration of the solids.

BRIEF SUMMARY OF THE INVENTION

According to the present invention, there is provided a method of accelerating and pressurizing a fluidized stream of particulate material, comprising causing the stream flow through a constriction in a main conduit and discharging a flow of blast medium towards the constriction, characterized in that the blast medium is accelerated to a supersonic speed before being discharged into the fluidized stream and forms within the fluidized stream a flow front which is impenetrable by the fluidized stream and which co-operates with the constriction to accelerate the fluidized stream.

The acceleration of the blast medium may be effected by means of a constriction in a flow passage for the blast medium.

By supplying the blast medium at sonic speed to the constriction in the blast medium passage, the blast medium can be accelerated to supersonic speed, and shock fronts are then formed in the blast medium, downstream of the blast medium passage, within the flow front. In this way there is formed within the fluidized stream an impenetrable volume which is defined by the flow front and which tapers downstream into the main conduit constriction so as to define therewith a virtual or effective Laval nozzle through which the fluidized stream is accelerated.

After passing through the throat of the virtual Laval nozzle, the fluidized stream is allowed to expand in a controlled manner, and may then be passed through a further constriction and thereby further accelerated and shaped for discharge as a spray, or may alternatively be fed further along the main conduit for subsequent further acceleration.

BRIEF DESCRIPTION OF THE DRAWINGS

The invention will be more readily apparent from the following description thereof with reference to the accompanying drawings, in which.

THE PREFERRED EMBODIMENTS

Figure 1:
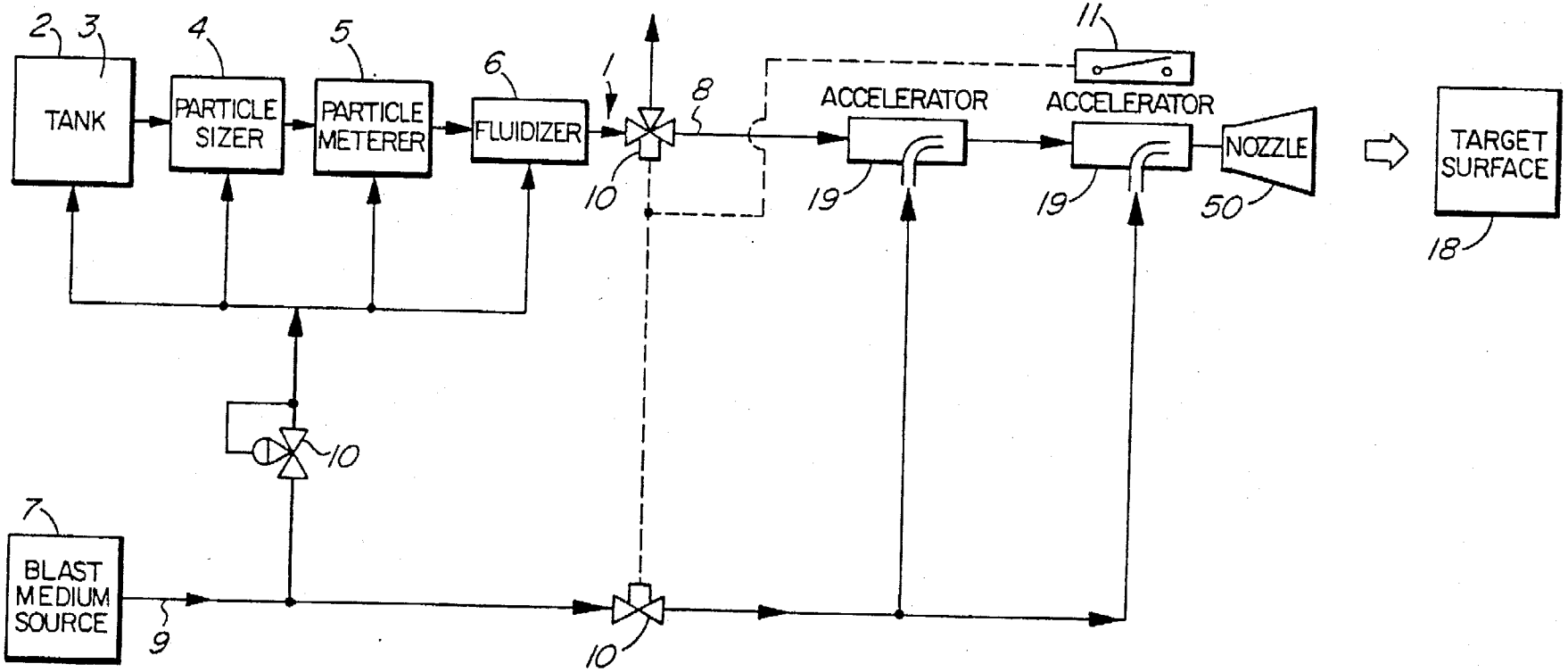
FIG. 1 is a flow diagram of a particle blast cleaning and treating system, according to the present invention, wherein a wide variety of particulate matter and blast medium may be used.

Referring to the drawings and in particular to FIG. 1, there is illustrated a particle blast cleaning and treating system designated generally by reference numeral 1, comprising a tank 2 for making and/or storing particulate matter 3, a particle sizer 4, a particle meterer 5, a particle fluidizer 6, a fluidizing and high pressure blast medium source 7 for providing a pressurized blast medium and supplying the blast medium through a conduit 9 for fluidizing the blast particulate matter, a conduit 8 for transporting the fluidized particulate stream to two fluid accelerator and pressurizer apparatuses 19 attached in series to a discharge nozzle 50, control valves 10, and a deadman switch 11 for turning off and on the particle blast cleaning and treating system 1.

The particulate matter 3 is made, normally continuously or upon demand in the case of water ice or dry ice, or stored, normally in the case of sand, grit or shot particles, in the particulate tank 2. This particulate matter 3 may either be delivered to the particle fluidizer 6 directly or may be sized by the particulate sizer 4 for even metering by the particle meterer 5 and then fluidized for transport. It will be understood by those skilled in the art that, instead of using the particle meterer 5, the metering of the particles may be accomplished by controlling the production rate of the particulate matter 3 in the tank 2 and that by fluidization may be incorporated into a common system consisting of the tank 2 and the particle sizer 4. Fluidization occurs by introduction of a fluidizing medium, which may be gas, liquified gas or liquid, at a controlled pressure from the conduit 9. It will also be understood that the lesser but necessarily higher quality medium source to be provided in conduit 8 for fluidization and transport may advantageously be different from that supplied to conduit 9, which primarily provides high pressure energy blast medium to the apparatuses 19, in terms of quality, pressure, coldness and dryness. If the fluidized particulate stream must be transported over a long distance to a target surface 18, then it is preferable that at least one fluid accelerator and pressurizer apparatus 19 be placed at one or more intermediate positions along conduit 8 to provide boost, as shown in FIG. 1. Otherwise, conveyance to the final delivery outlet is facilitated by the combined action of the particle fluidizer 6 and one fluid accelerator and pressurizer apparatus 19. In any case, at the final delivery outlet of the particle blast cleaning and treating system 1, one of the fluid accelerator and pressurizers 19 is attached in series to a discharge nozzle 50 to allow for the delivery of an evenly distributed large blast pattern against the target surface 18.

Figure 2:
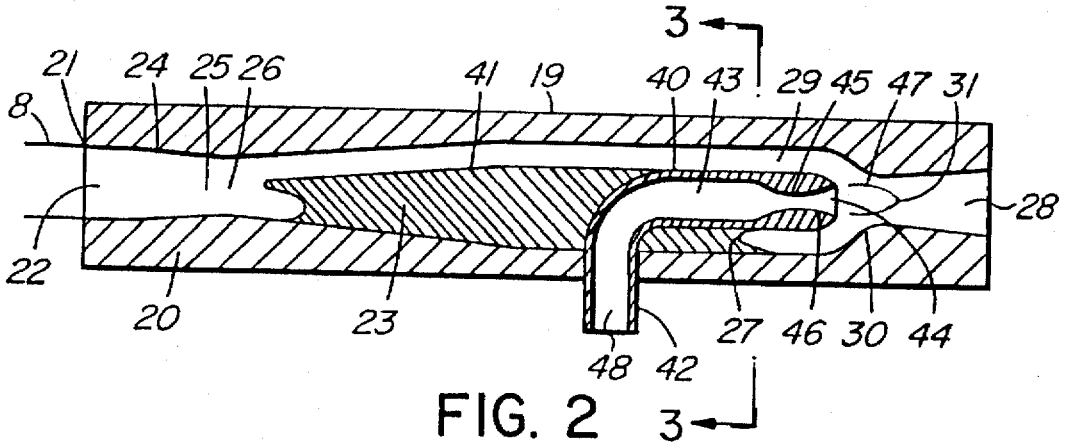
FIG. 2 is a lateral sectional view of a fluid accelerator and pressurizer apparatus forming part of the system of FIG. 1;.
Figure 3:
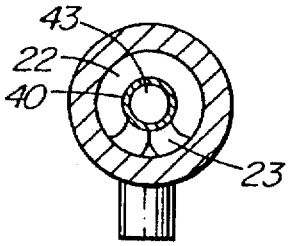
FIG. 3 is an end sectional view of the apparatus of FIG. 2.

FIGS. 2 and 3 show in greater detail one of the fluid accelerator and pressurizers 19. The conduit 8, preferably a flexible hose, is coupled at an inlet end 21 to a main conduit forming a flow passage 22 extending through a fluid accelerator and pressurizer nozzle housing 20, which contains an inner blast nozzle 40. A fairing 23 secures the inner blast nozzle 40 to the main conduit's inner surface or wall 24. The external surface 41 of the fairing 23 of the blast nozzle 40 is of an efficient streamlined, fusiform shape. This fusiform shape has the shape of a torpedo with a "tapered tail" end facing inlet 21 and a "head" end facing outlet end 28 of the main conduit 22.

The cross-sectional area of the inner surface 24 preferably converges slightly or remains unchanged from the inlet 21 to an initial convergent-divergent region or first constriction 25 in the form of a converging/diverging nozzle located upstream from the inner blast nozzle 40. The flow passage 22 then gradually diverges from the throat of the nozzle 25 to provide a first acceleration region 26. Further, the flow passage 22 is contoured to provide an intermediate region which may be of constant semi-annular cross-sectional area between the inner surface 24 and the fairing 23 until a point 27 prior to an outlet end portion 44 of the inner blast nozzle 40. It will be understood that the annular cross-sectional area between the flow passage wall 24 and the fairing 23 may form a nozzle shape whereby flow straightening, pressure and velocity conditions may be adjusted. After this point 27, the inner blast nozzle 40 projects from the fairing 23 towards the outlet 28 of the flow passage 22. Because the diameter of the flow passage 22 is unchanged during this projection, the cross-sectional area of the flow passage 22 between the inner surface 24 and the blast nozzle surface 41 is greater downstream from the point 27 than it is upstream from the point 27. This enlargement provides for a second divergence, and in the case of a gaseous or liquified gaseous fluidizing blast medium, i.e. a compressible blast medium capable of expansion, an acceleration region 29 in the flow passage 22. This arrangement creates a three-dimensional varying flow path to avoid plugging and provide acceleration, mixing and even distribution for a co-axial flow and system pressure. Specifically, the minimum distance between inner surface 24 of the flow passage and the outer surface of the inner blast nozzle and fairing is based on the specific particle size and the characteristics of the fluidized stream being treated, where the minimum preferred distance is 1.5 to 2.0 times the mean particle size diameter.

A high pressure blast medium tube 42 penetrates the flow passage 22 and communicates with a conduit 43 of the inner blast nozzle 40. The conduit 43 is co-axial with the flow passage 22. The blast medium, indicated by reference numeral 48 and in gaseous or liquified gaseous form, capable of partial or whole expansion upon discharge from the inner blast nozzle, is directed through the tube 42 from fluidizing medium source 7. The inner blast nozzle conduit 43 is constant in diameter from the end of blast medium tube 42 to a constriction 45 in the form of a Laval nozzle throat, which is upstream from the outlet of the inner blast nozzle 40, and which is followed by a divergence region 46.

At some distance downstream from the inner blast nozzle outlet 44, the surface 24 of passage 22 converges to a constriction 30 and then diverges, forming an acceleration region 28 of the passage 22. The blast medium 48 is forced through the nozzle throat 45 at a speed such that it leaves the outlet 44 at supersonic speeds, thus creating an impenetrable flow shear front 47. Between this flow shear front 47 and the walls of the nozzle throat 30, an effective or virtual Laval annular nozzle 31 is formed, which serves to accelerate the fluidized particulate stream and which may also reduce the size of friable particles to improve acceleration and blast impact.

The cross-sectional area of the flow passage 22, downstream of the point 27 is greater than the annular cross-sectional passage area or nozzle defined by the wall of the constriction 30 and the flow front 47.

More particularly, as the gas travels through the nozzle throat 45, the velocity of the gas may increase. If the velocity of the gas at the throat of the nozzle throat 45 is subsonic (even though the velocity increased), then the gas will decelerate. If the velocity of the gas at the nozzle throat 45 is sonic or above, then the gas will accelerate, which means that the velocity of the gas flow will then be supersonic. When the velocity of the gas leaving the nozzle 40 is supersonic, the gas will form shock waves within the flow shear front 47. For the fluidized stream, this front is practically impenetrable by the fluidized stream, thus forming a virtual wall profile.

This virtual wall profile, in conjunction with the constriction 30, forms a virtual or effective Laval nozzle therebetween, which accelerates the fluidized stream by exerting an inductive effect on the fluidized stream, thus producing a useful pressure boost for subsonic transport and/or increased velocities for a combined gas/particulate supersonic flow.

The shear forces of the high energy blast air at the flow front transfer kinetic energy from the high velocity blast air to the transport gas and the ice particles of the fluidized stream, thereby increasing their respective velocities rather than by random turbulent mixing and contact of particles with solid wall surfaces, which would cause attrition and erosion and would not be conductive to effective subsequent nozzle performance.

The inductive effect of the pressure boost by the virtual nozzle as described above is directly related to the volume of transport air carrying the particles through the annular throat of the virtual nozzle. When the flow is nil or small, the virtual nozzle is unchoked and the pressure boost provided by the first inner nozzle kinetic energy will be near one atmosphere, (14.7 psi). When the transport/particle volume flow is increased, the pressure boost is less as the virtual nozzle presents a pressure resistance to increasing flow. Thus, there is limited pressure boost available from an inductive nozzle which varies between max. 14 psi and 0 depending upon the flow of transport air with particles.

Under non-pressurized system conditions where the starting pressure at the source of ice particle production with adequate transport air volume is at atmospheric pressure (14.7 PSIA), the inductive effect will produce a vacuum of approximately 12.0 PSIA (0 PSIA is a full vacuum) located just prior to the outlet of the high energy blast nozzle.

Between this point and the point just after the throat of the virtual nozzle, the high energy blast air, transport gas and particulate matter will mix, and the part of the energy of the high energy blast air is transferred to the transport gas, thereby raising the pressure of the transport gas. Under normal operating conditions and with suitable nozzle configuration, the pressure of the mix including high energy blast air, transport gas and particulate matter can rise to as high as 16 PSIA.

Subsequently, the pressure of the mix has to decrease to atmospheric pressure, where the mix is finally discharged into the environment.

The foregoing operating conditions are suitable for ice blasting, but, such conditions can be modified if required.

As discussed above, when the flow velocity through the Laval nozzle throat formed by the constriction 45 is sonic, the resulting flow will be supersonic, which results in a better work effect. In the case of the virtual nozzle, the inventor has determined that a pressure of 16 PSIA is not high enough to generate a supersonic flow. Instead, what is required is a pressure differential above atmospheric, between 40–50 PSI, which means the pressure at the point just after the throat of the virtual nozzle should have a pressure of 54.7–64.7 PSIA.

The inventor has also determined that greater pressure differential above 40–50 PSI can result in higher supersonic speeds and therefore better work effect.

In the case of ice, and in order to avoid melting, agglomeration and plugging particles must not be exposed to warm moist air. However, cool dry air (also known as "high quality air"), is expensive to produce. The present apparatus requires the use of high quality air only as the transport gas, which normally only accounts for 20% or less of the total volume of gas in the system. The balance of the 80% or more is high energy blast air from the blast nozzle 40, which does not have to be high quality air.

The particulate matter does not have to travel at high speeds throughout the apparatus. It is only necessary that the particulate matter travels at a high speed at the discharge point. This facilitates avoidance of unwanted side effects such as conduit erosion, turbulence, mixing, increased friction, loss of efficiency, particle destruction, production of snow and lessened work effect. Also, large transportable particles may be more efficiently transported at low speed and any reduction in size useful for acceleration and work effect may be effected by adjusting shear force intensity in the jet fluid apparatus. Thus, the particulate matter is delicately transported along at a speed sufficient to avoid plugging but insufficient to create the desired blast effect, thereby allowing for maximal preservation of particles.

However, as the particulate matter passes through the virtual nozzle formed by the flow shear front 47 and the constriction, the intensity of the acceleration of the particulate matter can be adjusted. This is effected by varying the differential pressure and flow velocity at the virtual nozzle so as to correspondingly adjust the annular space between the flow shear front 47 and the wall of the constriction. In this way, the particulate matter, in the case in particular of ice particles, can be adjusted in size as a result of the shear force acting on the ice particles as they impact against the flow shear front 47.

Figure 4:
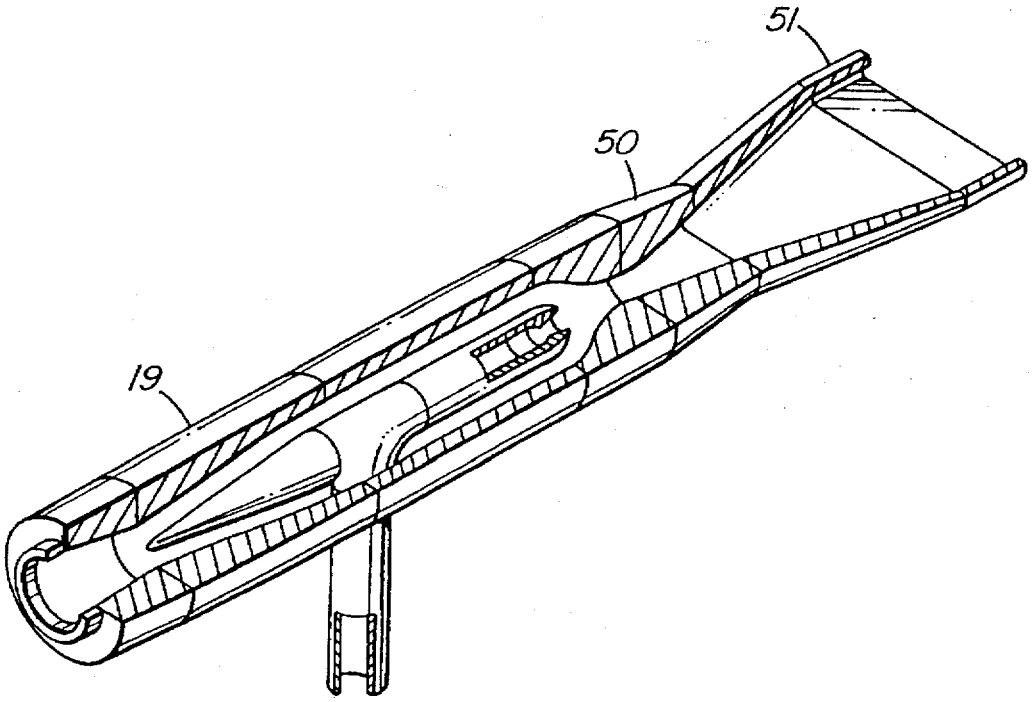
FIG. 4 is a fragmentary perspective view of a discharge nozzle connected in series with the apparatus of FIGS. 2 and 3.

FIG. 4 depicts a perspective view of the discharge nozzle 50 connected in series to one of the fluid accelerator and pressurizers 19. With the discharge nozzle 50 attached in series to the fluid accelerator and pressurizer 19 and sufficient pressure of all flows at or after the effective nozzle there is a further expansion and fluidic energy transfer and acceleration. This effective energy transfer from the blast medium 48 to the particles in the fluidized stream in the form of velocity assists in producing a linear strip or fan pattern having a high and even concentration of particles for impact. In such an arrangement, the duct profile after initial mixing in the main conduit makes a transition from a diverging annular flow to a transversely elongate, diverging rectangular form 51. The discharge nozzle 50 may have alternative forms, e.g. a circular, oblong or square form. In this way, the flow may be accelerated to sonic or supersonic speeds with an optimum pattern. For such an expansion to occur, it is necessary that the stream speed through the effective nozzle throat is sonic, and the upstream pressures are balanced as is described below in the example for water ice. Further, the transitional nozzle profile must consider maintaining even multi-phase distribution, mixing for particle acceleration, and dimensional criteria for plugging and pressure control.

A more complete understanding of the present invention can be obtained by referring to the following example of water ice or dry ice blasting of surfaces, which example is not intended to be limitative of the invention. In a conventional environment of ice blasting apparatus and methodology, comprising mechanisms for ice making, ice particle sizing, metering and fluidizing or ice making, ice particle sizing and fluidizing using high quality pressurized air (20% cold and dry air, 80% ambient air), fluid accelerator and pressurizers 19 are used to transport a fluidized ice particle stream over long distances to a final delivery and discharge point, and also to discharge the fluidized stream against a target surface.

In the ice blasting context, from the nozzle throat 25 there is slight acceleration of the incoming fluidized stream of ice particles and air, which is fed in the range from a moderate vacuum to 15–25 psig. The resulting fluid stream is then directed along the body of the inner blast nozzle 40 and the fairing 23 as a partial annular flow.

At the next acceleration region 29, the fluidized stream becomes a full annular flow and is again slightly accelerated. The partial and full annular flows are designed to minimize plugging and maximize energy transfer from the blast medium stream. The fairing 23 prevents the formation of velocity differentials that cause deposition and plugging.

The blast medium 48, which in this case consists of low quality cool dry air, is introduced through the blast medium tube 42 and the inner blast nozzle conduit 43 at 100–450 psig. At the inner blast nozzle throat 45, the air is forced to reach sonic speed. Following this point, the blast medium decompresses reaching a supersonic speed and forms the effective nozzle. The annular fluidized stream, travelling at subsonic speed, is unable to penetrate the flow from 47 and, due to the shear and inductive forces of the flow front 47 moving at a high speed and the convergence of the surface 24 of the passage 22 at the nozzle throat 30, the annular fluidized stream is significantly accelerated and its pressure is boosted up to 15 psig or greater. The configuration of this effective nozzle is dependent upon the proximity of the inner blast nozzle outlet 44 to the convergence of the passage 22 at nozzle throat 31, the velocities and flows of the blast medium 48 and the fluidized stream. The ratio between the pressures and volumes of the incoming fluidized stream and the blast medium are set at a range of 1:7 to 1:35 for the pressures and 1:7 to 1:14 for the volumes. It is preferable but not necessary that the ratio of these pressures remain in this range. A low ratio of volumes will result in choking at the nozzle throat 30, a rise in upstream pressure and consequently an interference with upstream fluidization and transport. If the ratio is too high, there will be inefficient use of the high energy blast medium and excessive volumes of the total mixed fluidized flow may also result in choking in throat 30 or subsequent nozzles.

Figure 5:
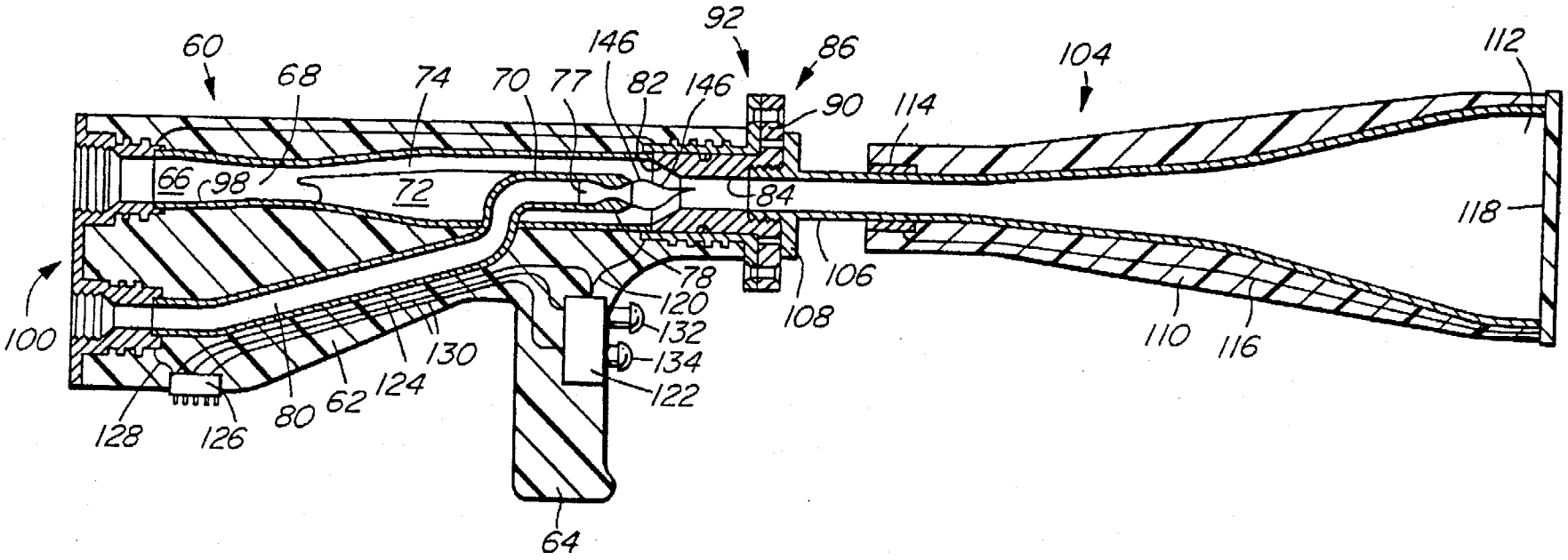
FIG. 5 shows a view in longitudinal cross-section through a discharge gun according to another embodiment of the invention.
Figure 6:
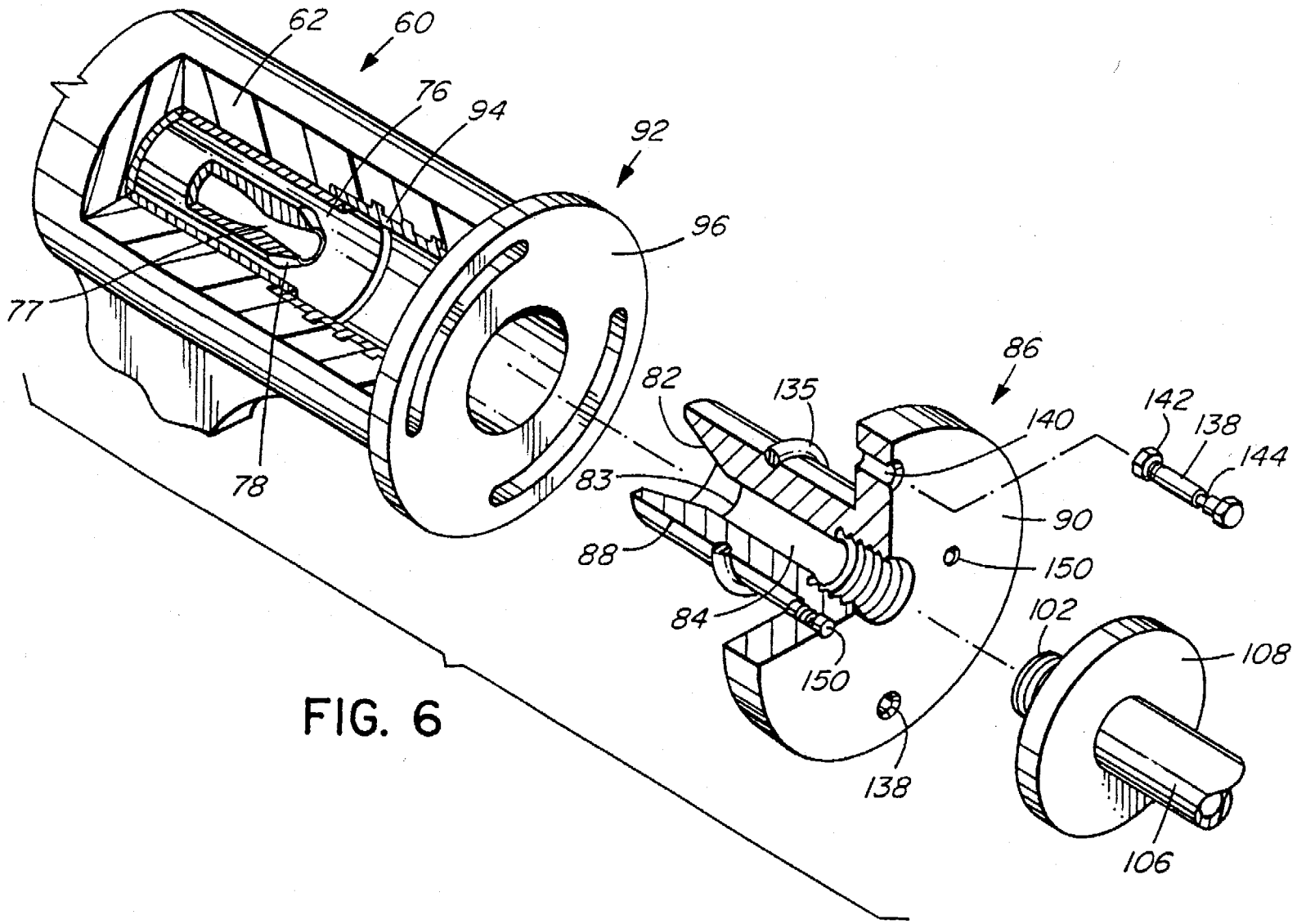
FIG. 6 shows a broken-away exposed view in perspective of parts of the gun of FIG. 5.

FIGS. 5 and 6 shows a modification of the apparatus of FIGS. 2 to 4.

In the apparatus of FIGS. 5 and 6, there is provided a gun indicated generally by reference numeral 60, which comprises a nozzle housing or body 62 provided with a handle 64. A flow passage 66 for the flow of a fluidized stream of transport gas and particulate material, for example, ice particles, is formed preferably with a first convergent-divergent constriction or Laval nozzle 68, with a blast nozzle 70 projecting into the flow passage 66. The blast nozzle 70 is provided with a fairing 72, and the flow passage 66, beyond the Laval nozzle 68, has a section of constant or varying cross-sectional area 74 extending in the downstream direction from the nozzle 68 to an enlargement 76, at which the nozzle 70 projects from the fairing 72 to provide the fluid passage 76 with an annular shape.

The blast nozzle 70 has an end portion 77 which includes a convergent-divergent constriction in the form of a Laval nozzle 78 for accelerating to supersonic speed a blast medium supplied to the nozzle 70 through a supply tube 80.

The blast nozzle 70 discharges into a converging passage portion 82, which communicates with the fluid passage 66 and extends to a constriction 83 communicating with a passage 84 of substantially constant cross-section. The converging passage portion 82 and the passage portion 84 extend through a component forming a nozzle member indicated generally by reference numeral 86, which has a cylindrical portion 88 extending into the body 62 and an annular flange portion 90 extending around one end of the cylindrical portion 88.

More particularly, the nozzle member 86 is rotatably mounted in an electrically conductive connector insert 92, which has an eternally ribbed cylindrical portion 94 embedded in the body 62 and a radially outwardly extending annular flange 96, which abuts the flange 90 of the nozzle member 86.

The connector insert 92 makes electrical contact with a conductive lining 98 on the wall of the fluid passage 66, and the conductive lining 98, in turn, makes electrical contact with a pair of threaded connectors indicated generally by reference numeral 100, which are formed in one piece of metal and embedded in the body 62. The insert member 86 is in threaded engagement with a threaded end portion 102 of a discharge nozzle indicated generally by reference numeral 104. The end portion 102 is provided on a tube 106, which is formed with an annular flange 108 abutting the nozzle member 86, and which extends through a plastic body 110 of the nozzle 104. The tube 106 forms a flow passage which initially has a circular cross-section, which merges into a rectangular cross-section at a discharge end 112.

Alternatively, for more convenient construction of the nozzle 104, the tube 106 may be replaced by a transitional cross-section lining, which may be made of stamped metal or any suitable conductive material in contact with bushing 114 and connected to the bushing 114 via threads. The conductive lining may be made by metallizing a plastic and the same applies to passage way 66. Also, the outside of the gun 60 and the nozzle 104 may be metallized.

The tube 106 is made of metal or made conductive as described above, and makes electrical contact with a conductive metal bushing 114. If the lining of nozzle 104 is not conductive, the busing may be connected by a grounding conductor 116 to a conductive strip 118 at the discharge end 112 of the discharge nozzle 104. Similarly if liner 98 of the flow passage 66 is not conductive, a grounding conductor 117 may connect the threaded connectors 100 to the ribbed cylindrical portion 94 of the conductive connector insert. The electrically conductive strip 118 is grounded through the conductor 116 and the conductive bushing 114. The strip 118 is useful, if the tube 106 terminates before the mouth of the nozzle 104.

The strip 118 is preferably formed to contact both the interior flow path of nozzle 104, and its outer surface in order to cancel static charge build-up.

In certain cases charge build-up is beneficial to work effect; where there is no hazard, for example from explosion, components such as the nozzle 104 may be changed, or grounding conductors may be interrupted by switching (not shown).

The connector insert 92 is connected through a conductor 120 to a switch 122, which is in turn connected through a conductor 124 to a connector plug 126 for connection to ground. The connecting member 100 is grounded by a conductor 128 through the plug 126.

The plug 126 is connected back to the ground connection of a plant supplying blast and transport medium, particles and its control system. The plug 126 may also be connected to a local ground and, as required, to the work piece. In this manner all of the chosen components as described above are safely grounded.

The switch 122 may have several functions. As described above, it may be used to temporarily interrupt grounding on certain components but always having fail safe to full grounding.

FIG. 5 shows switch 122 having two "deadman" type switches 132 and 134. The following is an example of such switch use for operational convenience and efficiency.

When the particle making and gas transport system has been activated but no switches used, there will be only a minimum amount of transport air being fed from conduit 8 (FIG. 1), into flow passage 66 (FIG. 5) and a minimum amount of high pressure blast medium from conduit 48 which enters supply tube 80 of FIG. 5.

This establishes a ready "idle" state, and provides inductive flow for the transport conduit to ensure against plugging and in the case of water ice, also melting.

Either of the switches 132 or 134 may be programmed to provide high velocity air only to clear the work piece prior to particulate blasting or after a section of the work is performed, or particulate blasting at pre-set rates and pressures from the system described in FIG. 1.

The cylindrical portion 88 of the nozzle member 86 is sealed to the electrical connector 92 by means of a sealing ring 135, which is recessed in the cylindrical surface of the cylindrical portion 88, and the cylindrical portion 88 tapers at its inner end so that the wall of the converging passage portion 82 merges smoothly with the inner surface of the lining 98 so as to counteract turbulence in the flow of material through the flow passage 66.

The flange 96 of the electrical connector 92 is formed with a pair of opposed arcuate slots 136, to allow articulation of the tube 106 and the nozzle 104 for work convenience and a pair of frangible bolts 138 extend through holes 140 in the flange 90 of the insert 86 and through the slots 136 into threaded engagement with retaining nuts 142. The bolts 138 are each formed with a weakened portion 144, which will break when the bolts 138 are subjected to a predetermined tensile load for pressure safety as described below.

The blast nozzle 70, the fairing 72 and the fluid passage 66 operate in a manner which corresponds to that described above with reference to FIGS. 2 to 4 and which therefore is not described in detail herein. Fluid discharged through an end portion 78 of nozzle 70 serves to form a flow shear front 146, similar to the flow shear front 47 of FIG. 2, and the flow shear front 146, in conjunction with converging passage portion 82 and constriction 83 form, likewise, a virtual or effective nozzle for accelerating the fluidized stream.

If the flow passage portion 84 should inadvertently become choked and plugged by deposition of particulate material, then the supply of blast medium at high pressure through the tube 80 could result in the creation of an abnormally high and dangerous pressure within the flow passage 66 and the components upstream of the flow passage 66 communicating therewith. To prevent this occurrence, the bolts 138 are formed with weakened portions 144, so that the bolts 138 will fail and the insert member 86 will be blown away from the body 62 if an unacceptably high excess pressure occurs in the flow passage 66.

The flange 90 of the insert 86 is penetrated by a pair of electrically conductive brushes 150, which make electrical contact, at opposite ends thereof, with the flange 96 of the electrical connector 92 and with the flange 108 on the tube 106. In this way, the tube 106 and, through the grounding conductor 116, the end conductor 118, are grounded through the electrical connector 92.

The bolts 138 are slidable to and fro along the slots 136 in order to allow the insert member 86, and therewith the discharge nozzle 104, to be rotated relative to the body 62 for correspondingly varying the orientation of the discharge from the discharge nozzle 104.

It will be understood from the foregoing description and apparent that various modifications and alterations may be made in the form, constriction and arrangement of the parts thereof without departing from the spirit and scope of the invention or sacrificing all of its material advantages, the form herein described being merely preferred embodiments thereof.

I claim:

1. A method of accelerating and pressurizing a fluidized stream of particulate material, comprising the steps of causing the stream to flow through a constriction in a flow passage; accelerating a blast medium to a supersonic speed; and discharging the blast medium at supersonic speed into the fluidized stream along the flow passage towards the constriction so as to form within the fluidized stream a flow front which is impenetrable by the fluidized stream and which co-operates with the constriction to accelerate the fluidized stream.

2. A method as claimed in claim 1, which includes employing a further constriction to effect the acceleration of the blast medium to supersonic speed.

3. A method as claimed in claim 2, which includes passing the fluidized stream through an enlargement of the flow passage located immediately upstream of the first-mentioned constriction and having a cross-sectional area greater than an annular cross-sectional area defined by the first mentioned constriction and the flow front.

4. A method as claimed in claim 1, which includes accelerating the fluidized stream and forming the fluidized stream into an evenly distributed blast pattern beyond the constriction.

5. A method as claimed in claim 1, which includes employing water ice as the particulate matter.

6. A method as claimed in claim 1, which includes accelerating the fluidized stream through a further constriction upstream from the discharge of the blast medium into the fluidized stream.

7. A method as claimed in claim 6, which includes by passing the fluidized stream through a passage having a constant cross-sectional area downstream from the further constriction.

8. A method as claimed in claim 1, which includes adjusting acceleration of the particulate matter at the constriction so as to effect correspondingly controlled reduction in the size of the particulate matter at the constriction.

* * * * *